US009067249B2

(12) United States Patent
Hoeffgen et al.

(10) Patent No.: US 9,067,249 B2
(45) Date of Patent: Jun. 30, 2015

(54) TAPERED-ROLL STAND FOR MAKING SEAMLESS PIPE

(71) Applicants: Walter Hoeffgen, Korschenbroich (DE); Thomas Leisten, Hueckelhoven (DE); Manfred Leferink, Cologne (DE)

(72) Inventors: Walter Hoeffgen, Korschenbroich (DE); Thomas Leisten, Hueckelhoven (DE); Manfred Leferink, Cologne (DE)

(73) Assignee: SMS MEER GMBH, Moenchengladbach (DE)

( * ) Notice: Subject to any disclaimer, the term of this patent is extended or adjusted under 35 U.S.C. 154(b) by 232 days.

(21) Appl. No.: 13/709,162

(22) Filed: Dec. 10, 2012

(65) Prior Publication Data

US 2013/0145808 A1 Jun. 13, 2013

(30) Foreign Application Priority Data

Dec. 9, 2011 (DE) ..... 10 2011 120 783

(51) Int. Cl.
*B21B 31/10* (2006.01)
*B21B 19/02* (2006.01)

(52) U.S. Cl.
CPC *B21B 19/02* (2013.01); *B21B 31/10* (2013.01)

(58) Field of Classification Search
CPC ..... B21B 13/008; B21B 17/02; B21B 17/04; B21B 19/06; B21B 31/08; B21B 31/10; B21B 19/02; B21B 19/00; B23B 19/04
USPC ..... 72/95, 224, 225, 237–239, 247–249, 72/455, 456
See application file for complete search history.

(56) References Cited

U.S. PATENT DOCUMENTS

| | | | | |
|---|---|---|---|---|
| 3,566,653 | A | 3/1971 | Unrath | |
| 4,052,876 | A | 10/1977 | Rotter | |
| 4,976,127 | A | 12/1990 | Rohde et al. | |
| 5,590,557 | A * | 1/1997 | Keller et al. | 72/238 |
| 5,875,671 | A | 3/1999 | Hauck | |
| 6,266,987 | B1 * | 7/2001 | Goto et al. | 72/95 |
| 6,546,772 | B2 * | 4/2003 | Hoffgen et al. | 72/237 |
| 2012/0279270 | A1 * | 11/2012 | Yabuta et al. | 72/247 |

FOREIGN PATENT DOCUMENTS

| | | |
|---|---|---|
| CN | 201841156 U | 5/2011 |
| CN | 201978942 U | 9/2011 |
| CN | 202045129 U | 11/2011 |

* cited by examiner

*Primary Examiner* — Shelley Self
*Assistant Examiner* — Pradeep C Battula
(74) *Attorney, Agent, or Firm* — Andrew Wilford

(57) ABSTRACT

A tapered roll stand for making seamless pipe has a stationary frame formed relative to a workpiece-travel direction with a pair of laterally and horizontally oppositely open windows. Respective cover doors carried on the frame are vertically shiftable between respective closed positions covering the respective windows and open positions offset therefrom and exposing the respective windows. A pair of tapered rolls are each shiftable horizontally through a respective one of the windows into a use position inside the frame, lying to a respective horizontal side of the direction, and rotatable about a respective axis forming an acute angle with the direction. A pair of Diescher disks are vertically engageable with a workpiece extending in the direction between the tapered rolls, and respective roll-positioning actuators carried on the doors are couplable with the tapered rolls in the use position for setting positions of the tapered rolls.

6 Claims, 3 Drawing Sheets

TAPERED-ROLL STAND FOR MAKING SEAMLESS PIPE

FIELD OF THE INVENTION

The present invention relates to the manufacture of seamless pipe. More particularly this invention concerns a roll stand having tapered rolls for making such pipe.

BACKGROUND OF THE INVENTION

A rolling stand or apparatus for making seamless pipe typically has a massive stationary frame on which are mounted two driven tapered rolls with frustoconical outer surfaces and two Diescher disks. The rolls flank a normally vertical travel plane that bisects the horizontally moving workpiece, and the Diescher disks are above—and below the workpiece. The tapered rolls are rotatable about respective axes that form opposite but complementary small acute angles with the workpiece, and the Diescher disks rotate about axes perpendicular to the travel plane. The raw tubular workpiece is pressed against a piercing rod or mandrel by the four rotating tools to longitudinally stretch and radially compress it into an exactly dimensioned seamless pipe.

As described in U.S. Pat. No. 6,546,772, the roll stand is formed two portal frames lying spaced apart in the workpiece-travel direction and connected to each other by a lower traverse and an upper traverse. The upper transverse is slidable in guides between the portal frames to facilitate insertion and removal of the rolls.

Changing the rolls in the known double tapered-roll apparatus with an upper and a lower frustoconical roll is a time-consuming and difficult operation. First, the upper traverse must be moved horizontally to the side in order then to be able to lift the frustoconical rolls one after the other out of the roll stand with a crane. The surrounding equipment does not permit a movement of both stand sides or portal frames, so that simultaneous replacement of both rolls is not possible. Instead, this always takes place consecutively, never at the same time.

OBJECTS OF THE INVENTION

It is therefore an object of the present invention to provide an improved tapered-roll stand for making seamless pipe.

Another object is the provision of such an improved tapered-roll stand for making seamless pipe that overcomes the above-given disadvantages, in particular that has a simplified design making a quick procedure for removing worn tapered rolls and replacing them with fresh rolls.

SUMMARY OF THE INVENTION

A tapered roll stand for making seamless pipe has according to the invention a stationary frame formed relative to a workpiece-travel direction with a pair of laterally and horizontally oppositely open windows. Respective cover doors carried on the frame are vertically shiftable between respective closed positions covering the respective windows and open positions offset therefrom and exposing the respective windows. A pair of tapered rolls are each shiftable horizontally through a respective one of the windows into a use position inside the frame, lying to a respective horizontal side of the direction, and rotatable about a respective axis forming an acute angle with the direction. A pair of Diescher disks are vertically engageable with a workpiece extending in the direction between the tapered rolls, and respective roll-positioning actuators carried on the doors are couplable with the tapered rolls in the use position for setting positions of the tapered rolls.

Thus according to the invention the tapered rolls lie next to one another horizontally in the roll stand, and are shiftable on a respective side of the roll stand through a mounting window. Roll adjusters or actuators are carried roll stand side cover doors that can be raised and lowered. To replace the rolls it is no longer necessary to release and displace an upper traverse, instead both tapered rolls can be replaced at the same time, namely drawn out of their respective windows orthogonally to the roll axis. After the opening of the roll stand sides by shifting the doors in opposite vertical directions, i.e. raising the one and lowering the other roll stand side closing cover by a hydraulic or pneumatic cylinders can be used, the unhindered insertion or removal of the tapered rolls is an easy job. The replacement of rolls thus no longer requires a very time-consuming displacement or lifting or pivoting the upper stand half, so that due to the much shorter roll replacement times achieved according to the invention the service time of the roll stand is also improved.

The rolls oriented horizontally next to one another according to the invention further renders possible large roll spreading angles, in turn is advantageous in terms of forming because it makes larger outside tube diameters possible. With the known roll arrangement one above the other, large spread angles (>20°) cannot be realized due to the increased installation height of the roll stand drive unavoidably associated therewith.

According to an advantageous embodiment of the invention, linear guides carrying moveable tapered roll replacement units, for example, replacement carts or moveable slides, extend horizontally orthogonally to the rolling axis or workpiece travel direction. They are each aligned with a respective one of the mounting windows of the tapered roll mounts. The automated simultaneous replacement of the two tapered rolls is further promoted in this way.

Another advantageous embodiment of the invention provides Diescher disk units arranged vertically in the roll stand, one above and one below. This also contributes to there being sufficient space for the simultaneous roll change in the region of the mill floor on the right and on the left of the workpiece travel direction or next to the roll stand.

BRIEF DESCRIPTION OF THE DRAWING

The above and other objects, features, and advantages will become more readily apparent from the following description, reference being made to the accompanying drawing in which.

DETAILED DESCRIPTION

Figure 1:
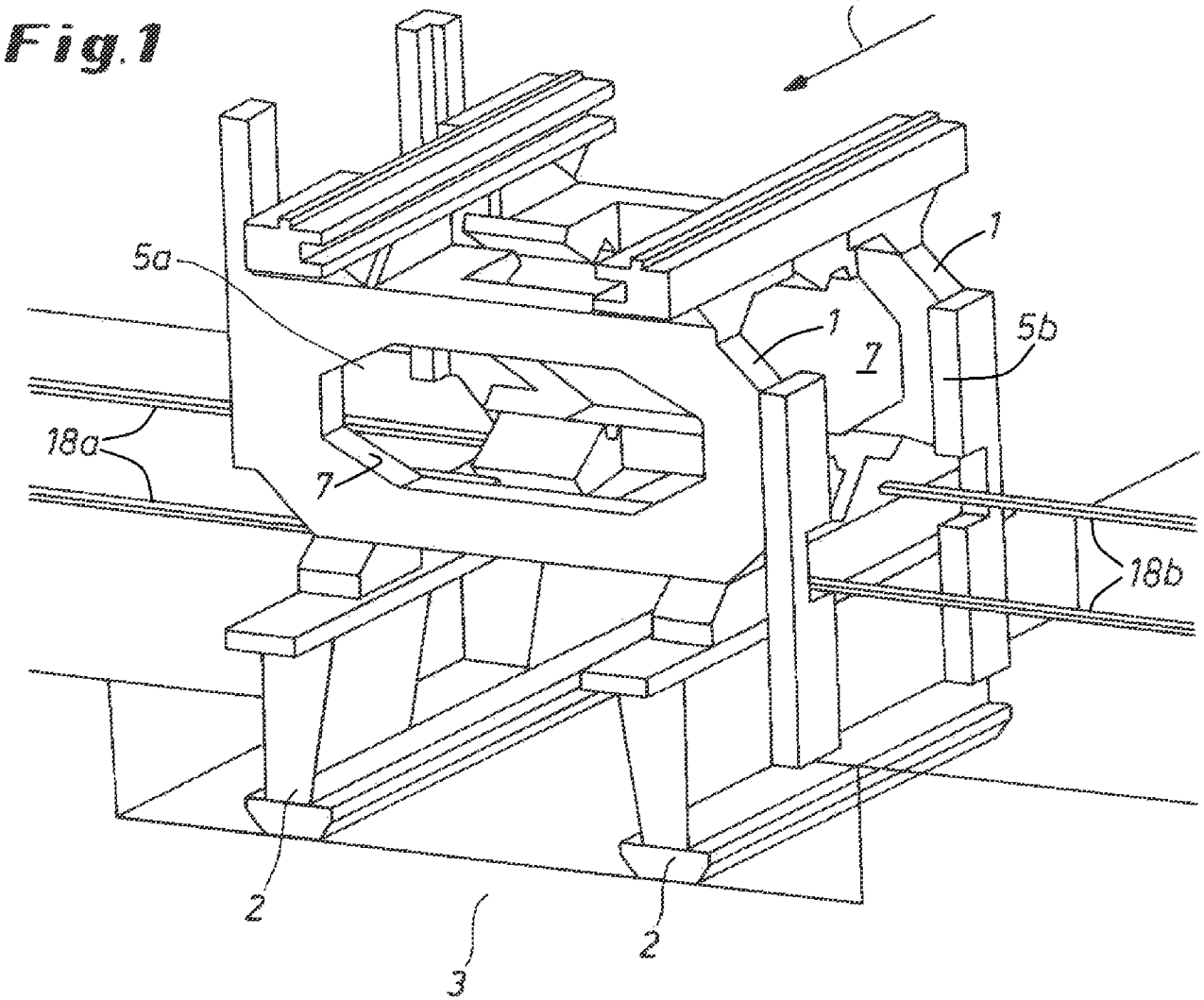
FIG. 1 is a perspective view of a stripped roll-stand frame according to the invention.

As seen in FIG. 1 a roll stand formed by a pair of vertical massive frame plates 1 is attached to a base or foundation 3 via sole plates 2. The plates 1 are spaced apart relative to a horizontal workpiece travel direction 4 lying in a vertical plane 4' (FIG. 2) and extend perpendicular to the direction 4, lying in respective vertical planes spaced apart in the direction 4. They form laterally open windows 5*a* and 5*b* through which tapered rolls 6*a* and 6*b* can be moved into and out of the space between them. In addition each frame plate 1 is formed with a large hole 7 through which a workpiece W passes in the direction 4 when being rolled into a seamless pipe.

Figure 2:
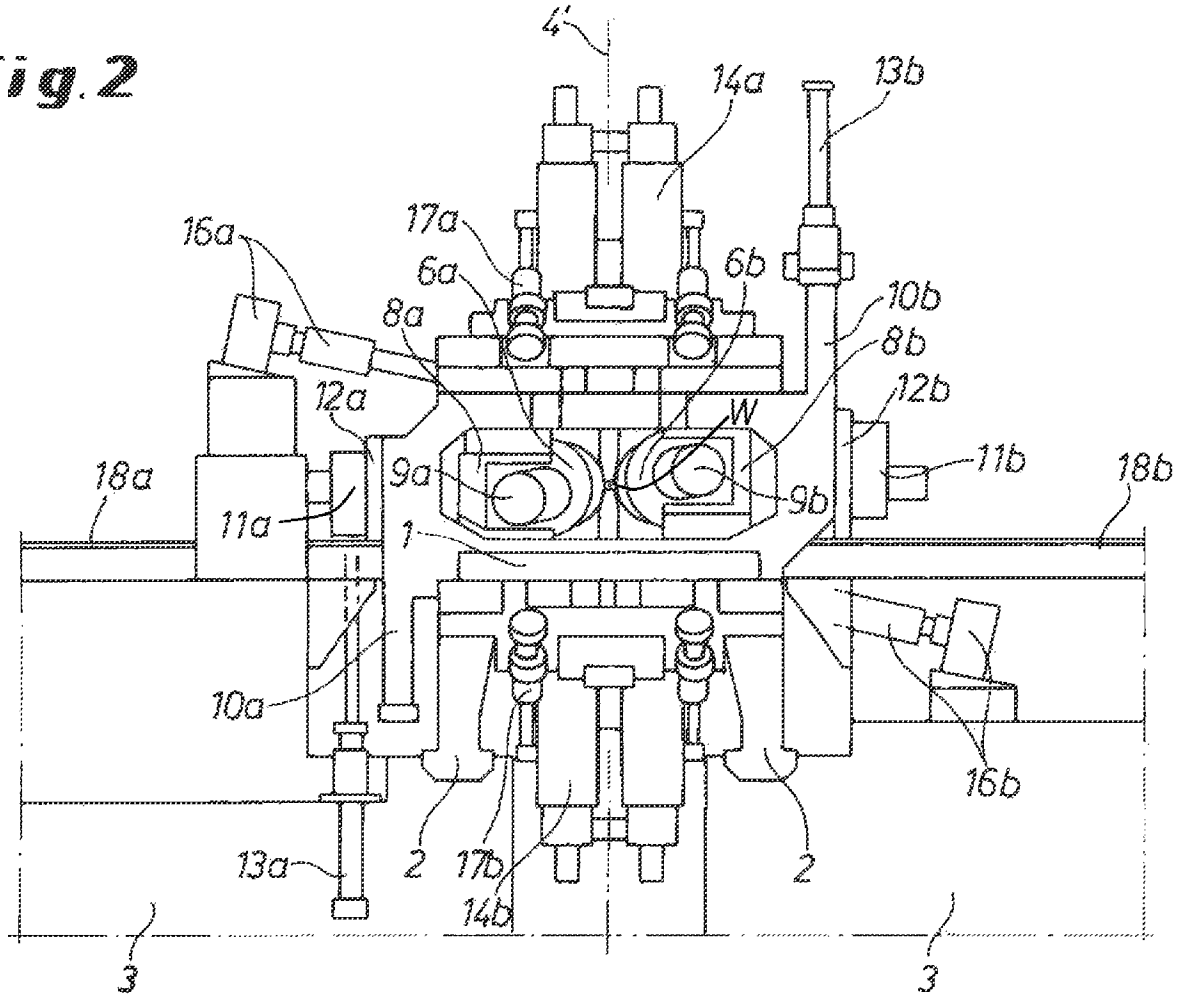
FIG. 2 is the rolling apparatus of this invention set up for rolling and seen in the travel direction from the output side.

FIG. 2 shows the two tapered rolls 6*a* and 6*b* supported in respective mounts 8*a* and 8*b*, pointing forward with their drive connectors 9, horizontally next to one another, and symmetrically flanking the roll plane 4' at an angle, i.e. diverging toward the exit side. Frame-like guide stands 10*a* and 10*b* on the right and on the left defining the windows 5*a* and 5*b* are fixed on the roll stand 1. Each guide stand 10*a* and 10*b* has rails slidably supporting a respective cover door 12*a* and 12*b* carrying a respective actuator 11*a* and 11*b* for the tapered rolls 6*a* and 6*b*. These doors 12*a* and 12*b* with their actuators 11*a* and 11*b* can be raised or lowered via by respective lift cylinders 13*a* and 13*b*, one here above and one below the respective frame-like guide stand 10*a* and 10*b*.

Upper and lower assemblies 14*a* and 14*b* carry respective Diescher disks 15*a* and 15*b* (see FIG. 3) on above the other and both lying in the plane 4'. Furthermore, FIG. 2 shows upper and the lower drive 16*a* and 16*b* connected via swivel shafts to the disks 15*a* and 15*b*. The Diescher disk assemblies 14*a* and 14*b* can be pivoted away from the roll plates 1 upward or downward by respective cylinders 17*a* and 17*b*.

Figure 3:
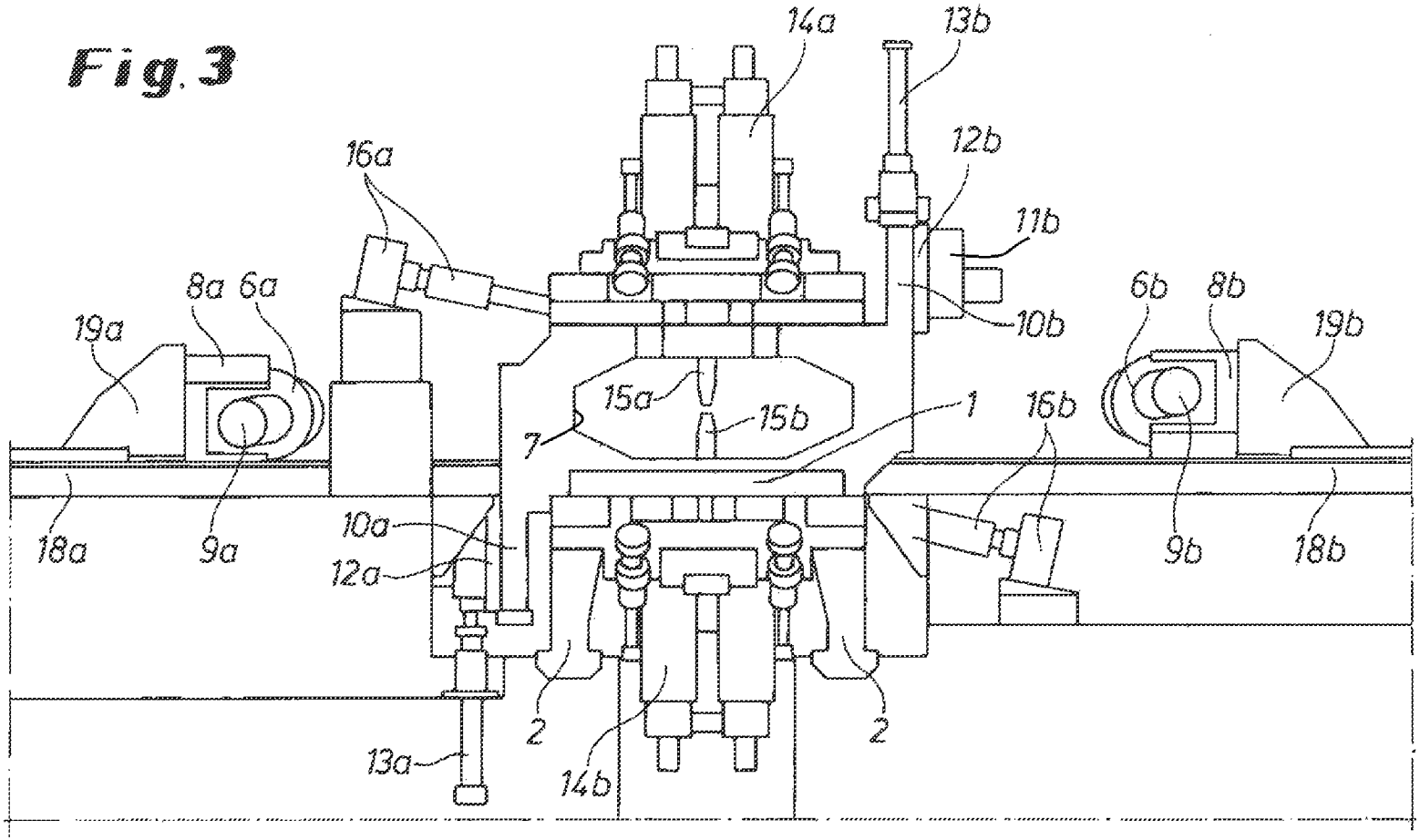
FIG. 3 is a view like FIG. 2, but showing the apparatus during a roll-change operation.

FIG. 3 shows the tapered roll mill in the replacement position of the tapered rolls 6*a* and 6*b*. For removal or roll replacement the left lift cylinder 13*a* has lowered the stand side closing cover 12*a* and the right lift cylinder 13*b* has raised the stand side closing cover 12*b* there so that the left and the right access via the windows 5*a* and 5*b* to the mounts 8 with the tapered rolls 6*a* and 6*b* for the simultaneous and automatic withdrawal by roll-replacement units 19*a* and 19*b* on linear guides 18*a* and 18*b* orthogonally to the roll axis 4 through the mounting windows 5*a* and 5*b* (see FIG. 1) is possible. In the position shown, where for roll removal the drive trains not shown have been previously uncoupled from the connectors 9, the roll-replacement units 19*a* and 19*b* holding the respective tapered rolls 6*a* and 6*b* and their mounts 8 are on both sides at a spacing from the tapered roll mill in a position providing sufficient space for the replacement of the tapered rolls to the right and left next to the tapered-roll stand. The new tapered rolls are thereafter likewise simultaneously moved into the roll stand again and secured there, so that after moving out the tapered roll replacement units 19*a* and 19*b* and raising or lowering the stand side closing cover 12*a* and 12*b* the tapered roll mill is ready for operation.

We claim:

1. A tapered roll stand for making seamless pipe, the stand comprising:

a stationary frame formed relative to a workpiece-travel direction with a pair of laterally and horizontally oppositely open windows;

respective cover doors carried on the frame and vertically shiftable between respective closed positions covering the respective windows and open positions offset therefrom and exposing the respective windows;

a pair of tapered rolls each shiftable horizontally through a respective one of the windows into a use position inside the frame, lying to a respective horizontal side of the workpiece-travel direction, and rotatable about a respective axis forming an acute angle with the workpiece-travel direction;

a pair of Diescher disks vertically engageable with a workpiece extending in the workpiece-travel direction between the tapered rolls; and respective roll-positioning actuators carried on the doors and couplable with the tapered rolls in the use position for setting positions of the tapered rolls.

2. The roll stand defined in claim 1, further comprising:

respective means for shifting the rolls outwardly away from each other through the respective windows into outer replacement positions.

3. The roll stand defined in claim 1, wherein each of the means includes a respective horizontal track extending horizontally transverse to the workpiece-travel direction each through a respective window and way from the frame.

4. The roll stand defined in claim 1, wherein one of the Diescher disks is above the other of Diescher disks, the roll stand further comprising:

means for shifting the one Diescher disk upwardly out of the frame and for shifting the other Diescher disk downwardly out of the frame.

5. The roll stand defined in claim 1 wherein the means for shifting the Diescher disks pivots them about respective horizontal axes perpendicular to the workpiece-travel direction.

6. The roll stand defined in claim 1, wherein each of the tapered rolls has at least one end mount replaceable with the respective roll and securable in the frame in the use position of the respective roll.

* * * * *